United States Patent [19]

Sawa et al.

[11] 4,022,701

[45] May 10, 1977

[54] HIGH-PERFORMANCE ANISOTROPIC PLASTICS MAGNET AND A PROCESS FOR PRODUCING THE SAME

[75] Inventors: Shigeki Sawa; Takeshi Anbo, both of Tokyo; Kiyoshi Otani; Yoshikazu Kutsuwa, both of Ichihara, all of Japan

[73] Assignees: Japan Special Steel Co., Ltd.; Mitsui Polychemicals, Co., Ltd., both of Tokyo, Japan

[22] Filed: Apr. 28, 1975

[21] Appl. No.: 572,293

[30] Foreign Application Priority Data

Apr. 26, 1974 Japan ..... 49-49263

[52] U.S. Cl. ..... 252/62.54; 252/62.51

[51] Int. Cl.[2] ..... H01F 1/00; H01F 1/26

[58] Field of Search ..... 252/62.51, 62.52, 62.54

[56] References Cited

UNITED STATES PATENTS

| | | | |
|---|---|---|---|
| 2,999,275 | 9/1961 | Blume | 252/62.63 X |
| 3,117,092 | 1/1964 | Parker | 252/62.54 |
| 3,221,315 | 11/1965 | Brown et al. | 252/62.54 X |
| 3,649,541 | 3/1972 | Ingersoll | 252/62.54 |
| 3,677,947 | 7/1972 | Ray et al. | 252/62.54 |
| 3,867,299 | 2/1975 | Rohatgi | 252/62.54 |
| 3,884,823 | 5/1975 | Clendenen et al. | 252/62.63 |

*Primary Examiner*—F.C. Edmundson

*Attorney, Agent, or Firm*—Wenderoth, Lind & Ponack

[57] ABSTRACT

An anisotropic plastics magnet having a maximum energy product (BH)max not lower than 0.9 MG Oe, a remanence Br not lower than 2000G and a coercive force Hc not lower than 1800 Oe, and being composed at least one of ferromagnetic powders having a large magnetic anisotropy constant and at least one selected from the group consisting of metal-cross-linked copolymers of $\alpha$-olefin and $\alpha,\beta$ unsaturated mono- or dicarboxylic acid and saponified copolymers of ethylene and vinyl acetate, the axis of the easy magnetization of said ferromagnetic powders being oriented substantially in one direction, and a process for producing the same comprising mixing the ferromagnetic powder and the resin and forming the mixture under heating while a magnetic field is being applied.

6 Claims, 3 Drawing Figures

○ Na crosslinked copolymer of ethylene and metacrylic acid (Present Invention)

● Saponified copolymer of ethylene and vinylacetate (Present Invention)

△ Copolymer of ethylene and vinylacetate

□ Ethylene-vinylacetate copolymer + polyisobutylene

× Low-density polyethylene

HIGH-PERFORMANCE ANISOTROPIC PLASTICS MAGNET AND A PROCESS FOR PRODUCING THE SAME

The present invention relates to a high-performance anisotropic plastics magnet made of a mixture of ferromagnetic powder having a large magnetic anisotropy constant and a thermoplastic resin and a process for producing the same.

It is conventionally known to produce a plastics magnet or a rubber magnet by mixing a thermoplastic resin such as polyvinyl chloride, polyethylene and chlorinated polyethylene or a natural or synthetic rubber with magnet powders. Thus, it is easy to produce an isotropic plastics or rubber magnet by mixing magnet powders with a synthetic resin or rubber, but the magnetic properties of the magnet thus produced are lower than that of an isotropic sintered magnet by a value corresponding to the volume of the resin or rubber mixed with the magnet powder, and its application is limited to a very narrow field.

In order to produce a plastics or rubber magnet having magnetic properties better than that of an isotropic sintered magnet, it is necessary to arrange the ferromagnetic powders in a certain direction so as to give anisotropy to the arrangement of the powder particles.

Further, in order to increase the magnetic properties, it is desirable that the ferromagnetic powders be each a single crystal, that the particle size of the powder be within the magnetic single domain which is determined by the magnetic anisotropy constant, and that the crystal structure of the powders be complete and free from defects such as a lattice strain.

When anisotropy is given to the arrangement of these powders, particularly when a thermoplastic resin is used and the magnetic field is applied, the easily magnetizable axis of the mixed ferromagnetic powders rotates and orientates in the direction of the applied magnetic field, and the molten viscosity of the resin used has a great influence on the magnetic properties of the magnet. Thus, the magnetic properties are in proportion to the orientation rate of the easily magnetizable axis of the ferromagnetic powders and their volume. In order to increase the orientation rate, it is necessary that the viscosity of the mixture composed of the resin and the ferromagnetic powder be so low that the easily magnetizable axis may rotate fully in the applied direction of the magnetic field. On the other hand, when the amount of the powders mixed is increased in order to increase the magnetic properties, the viscosity is increased and the orientation rate lowers. Therefore, as for the desirable properties of the resin, it is desirable that the resin permits a large amount of the ferromagnetic powders and that the viscosity of the resin be low at the time of the magnetic field application.

Further, when an anisotropic plastics magnet is produced by injection forming while the magnetic field is being applied, not only the static molten viscosity as above but also the fluidity have a great influence.

The present inventors have conducted various extensive studies on various thermoplastic resins having excellent viscosity and fluidity under the heated condition, and have found that an excellent formability and a high level of magnetic properties can be obtained from a metal cross-linked resin from a copolymer of $\alpha$-olefin and $\alpha,\beta$ unsaturated mono- or dicarboxylic acid and in case a saponified resin from an ethylene-vinyl acetate copolymer.

The gist of the present invention lies in the production of an anisotropic plastics magnet composed of a mixture of one or more ferromagnetic powders having a large magnetic anisotropy constant and a synthetic resin which is characterized in that one or more of a metal cross-linked resin from a copolymer of $\alpha$-olefin and $\alpha,\beta$ unsaturated mono- or dicarboxylic acid and a saponified resin of a copolymer of ethylene and vinyl acetate is used as the synthetic resin and the molding is done while the magnetic field is applied under a heated condition.

The metal cross-linked resin used herein means an ionic copolymer as generally called, which is a copolymer of $\alpha$-olefin and a vinyl monomer having a carboxyl acid groups, in which molecules are cross-linked by a metal ion utilizing the carboxyl acid groups. Under a heated condition, the cross-linking is readily broken and excellent fluidity is obtained, and after cooling, the molecules are again cross-linked to provide a rigid polymer.

The saponified resin of the ethylene-vinyl acetate copolymer used herein means a resin obtained by introducing a hydroxyl group (OH) into the molecule through hydrolysis of the ethylene-vinyl acetate copolymer resin.

These resins are characterized in that their viscosity largely depends on temperature, and as the temperature increases, their viscosity lowers sharply.

According to the conventional injection molding of a plastics magnet using magnet powders and thermoplastic resins, it is usual to mix the magnetic powders in an amount of about 85% by weight as disclosed in Japanese Patent Publication No. Sho 39-28287 and British Patent Specification No. 1,116,861. It has been conventionally considered that a larger amount of the magnet powders lowers the fluidity and hinders the molding.

According to the present invention, it is possible to mix the ferromagnetic powder in an amount as large as 89 to 91% by weight even in case of a particle size of $1\mu$ which corresponds to the single magnetic domain of a barium ferrite magnet, and the injection molding can be easily done. If the particle size of the powders is increased, the molding can be done satisfactorily even with a high mixing ratio of the powders.

In case of other polyvinyl chlorides, chlorinated polyethylenes and low-density polyethylenes, however the fluidity is low and satisfactorily molded articles can not be obtained with such a high mixing ratio of the magnet powders as above.

Further, according to the present invention, better mold formability and better magnetic properties can be obtained as compared with ethylene copolymers such as copolymer of ethylene-vinyl acetate and ethylacrylate.

The resins used in the present invention have good fluidity under the heated condition, so that complicated forms of magnets can be easily molded. With more complicated forms, it is possible to produce an anisotropic plastics magnet by injection molding without the magnetic field, then reheating and molding while applying the magnetic field.

As for the method for forming the plastics magnet in the present invention, a rolling method using rolls or an extrusion method can be used as well as the injection molding.

In the forming of the plastics magnet according to the present invention, the method of applying the magnetic field varies largely depending on the final forms to be obtained, and the application may be done straight, in parallel to the sliding direction of the mold, or in a radial direction, or in a plurality of poles. The magnetic field may be a pulse magnetic field or an ordinary d.c. magnetic field.

As for the magnet powders having a large magnetic anisotropy constant useful in the present invention, a ferrite magnet of $MO.6Fe_2O_3$ (M: one or more of Ba, Sr and Pb), a rare earth-cobalt magnet of $RCo_5$ (R: one or more of rare earth elements such as Sm, Pr, Y, La and Ce), a manganese-bismuth magnet, and a manganese-aluminum magnet may be used.

The metal cross-linked resin of the copolymer of $\alpha$-olefin and $\alpha,\beta$ unsaturated mono- or dicarboxylic acid used in the present invention is an ionic copolymer composed of a polymer containing at least 50 mole percent of units derived from $\alpha$-olefin having a general formula of $RCH=CH_2$ (in which R is hydrogen or alkyl group having 1 to 8 carbon atoms), and 0.2 to 2.5 mole percent of units derived from $\alpha,\beta$ ethylenically unsaturated mono- or dicarboxylic acid, in which one or more metal ions are dispersed, as disclosed in Japanese Patent Publication No. Sho 39-6810. In this case, when the above acid copolymer component is mono-carboxylic acid, the atomic valance of the metal ion is 1 to 3; when the component is dicarboxylic acid, the valance is 1, and the metal ion is present in an amount enough to neutralize at least 10% of the carboxylic acid.

As for most useful base copolymers used in the present invention, ethylene-acrylic acid copolymer, ethylene-metacrylic acid copolymer, ethylene-acrylic acid-metacrylic acid copolymer, ethylene-metacrylic acid-acrylic acid ester copolymer may be mentioned.

As for the metal ions used in the present invention, $Na^+$, $K^+$, $Li^+$ and $Cu^+$ may be used as a mono-valent metal ion, $Be^{++}$, $Mg^{++}$, $Ca^{++}$, $Ba^{++}$, $Cu^{++}$, $Fe^{++}$, $Co^{++}$, $Ni^{++}$ and $Zn^{++}$ may be mentioned as a divalent metal ion, and $Al^{+++}$, $Sc^{+++}$, $Fe^{+++}$ and $Y^{+++}$ may be mentioned as a trivalent metal ion.

Further, as for the saponified resin of ethylenevinyl acetate copolymer used in the present invention, a copolymer containing ethylene and 1 to 45% by weight vinyl acetate, and having a hydroxyl radical (OH) introduced into the molecule through hydrolysis is useful. An example of the reaction is shown under.

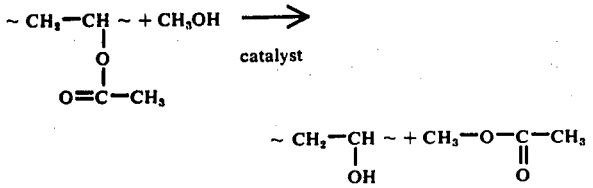

Thus, the ethylene-vinyl acetate copolymer is denatured into a copolymer of ethylene and vinyl alcohol, or a copolymer of ethylene vinyl alcohol and vinyl acetate by total or partial hydrolysis, thus introducing the hydroxyl radical (OH) into the molecule. The hydrolysis product of the ethylene-vinyl acetate copolymer thus obtained shows a higher melting point than the ethylene-vinyl acetate copolymer itself, and has better thermal stability at high temperatures.

In the present invention, the amount of vinyl acetate in the resin is defined to 1 to 45% by weight, more desirably 15 to 45% by weight, and its hydrolysis rate (saponification rate) is defined to 10 to 100%, preferably 25 to 100%.

The amount of the ferromagnetic powders used in the present invention varies depending on the kind and type as well as the particle size of the powder used. In case of the ferrite magnet powder of $MO.6Fe_2O_3$ (as defined hereinbefore), the amount is defined to 80 to 93% by weight, preferably 85 to 92% by weight. In case of the rare earth-cobalt magnet powder of $RCo_5$ (as defined hereinbefore), the amount is defined to 80 to 97% by weight, preferably 85 to 96% by weight. When the amount is less than the lower limit of the above ranges, the volume occupied by the ferromagnetic powder is small and thus the magnetic properties become lower. On the other hand, when the amount is beyond the upper limit, the molten viscosity of the mixture of the resin and the ferromagnetic powders increases and the orientation rate of the ferromagnetic powders lowers, resulting in extremely low magnetic properties and poor formability.

Also, 2000 Oe or more is required as the intensity of the magnetic field applied according to the present invention, and more than 3000 Oe is desirable.

Regarding the resins used in the present invention, one or more thermoplastic resins such as polyethylene, polypropylene, polystyrene, ethylene-vinyl acetate copolymer, and ethylene-ethylacrylate copolymer may be blended with one or more of the cross-linked resins of $\alpha$-olefin and $\alpha,\beta$ mono- or dicarboxylic acid copolymer and the saponified resin of ethylene-vinyl acetate copolymer in an amount not more than 50% by weight.

Brief explanations of the drawings are as follows.

The present invention will be more clearly understood from the following examples, but it should be understood that the present invention is not limited to the examples.

EXAMPLE 1

Figure 1:
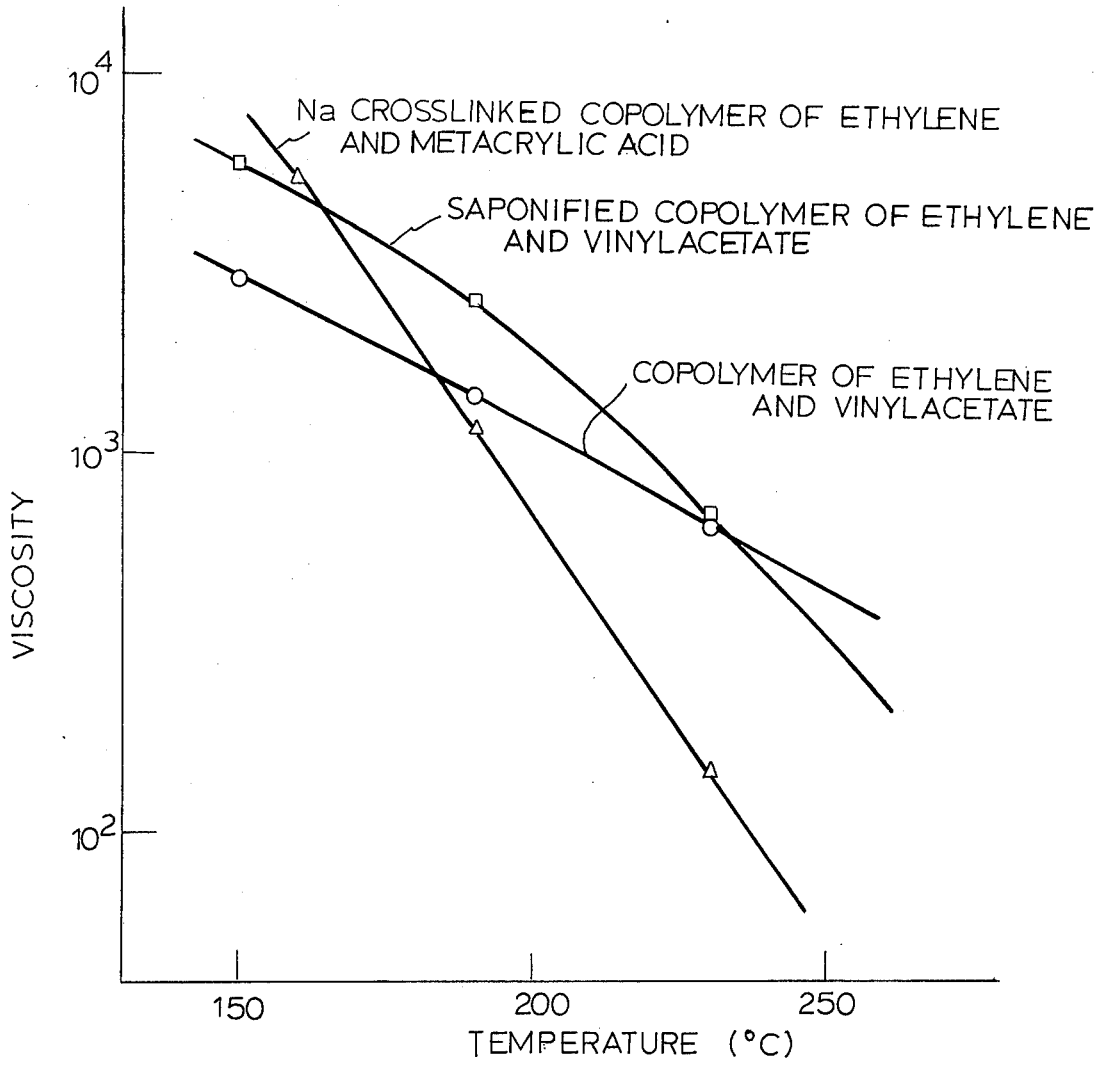
FIG. 1 is a graph showing changes due to temperatures in viscosity of the Na-cross-linked ethylene-metacrylic acid copolymer and the saponified ethylene-vinyl acetate copolymer used in the present invention.
Figure 2:
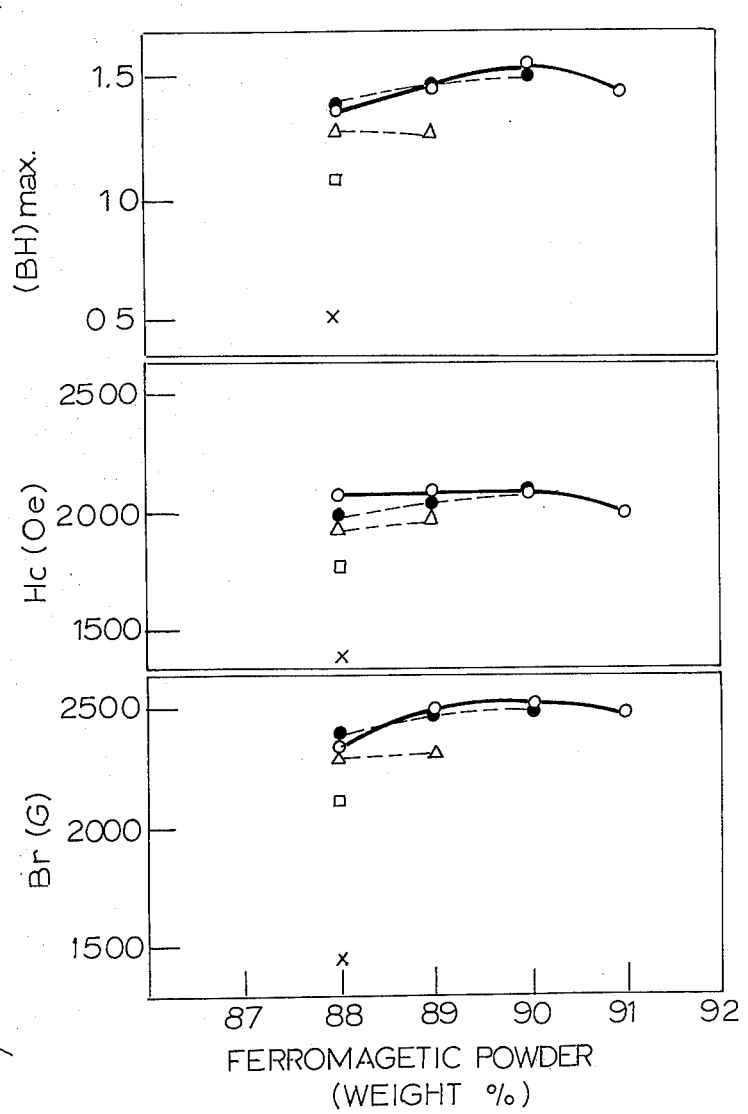
FIG. 2 shows the relation between the magnetic properties (Br, Hc, (BH)max ) and the amounts of the magnetic powders mixed with the resin.

Barium ferrite powders (average particle size: $1\mu$) of $BaO.6Fe_2O_3$ were subjected to strain-relieving annealing at 1000° C for 30 minutes to prepare mixing powders, and 88 to 91% of the powders were mixed with 9 to 12% of Na cross-linked resin of ethylene-metacrylic acid copolymer (AD8109 melting index 270 to 360 gr/10 min.) and 9 to 12% of hydrolysis saponified resin of ethylene-vinyl acetate copolymer (D219, melting index 180 gr/10 min.) at 150° C using two rolls to obtain a sheet, which was cut into tips of about 3 × 3 × 5 mm by a plastic cutter. Then the tips were melted and injection-molded at 270° C into samples of 24 mm diameter and 5 mm thickness with a magnetic field of about 12000 Oe applied. The results are shown in Table 1 and FIG. 2.

Table 1 shows also results obtained when low-density polyethylene FL-60 (melting index: 70 gr/10 min.), ethylene-vinyl acetate copolymer EV-410 (melting index: 400 gr/10 min.), and ethylene-vinyl acetate copolymer EV-210 (melting index: 400 gr/10 min.) + polyisobutylene L-80 were used under the same condition. As clearly understood from Table 1 in case of the Na cross-linked resin AD8109 of ethylene-metacrylic acid copolymer according to the present invention, it is possible to perform injection molding even when 89 to 91% by weight of the ferrite powder are filled in the resin and yet the magnetic properties are improved. In this way, by the use of barium ferrite magnet powders and the injection molding which facilitates mass-production, magnetic properties higher than (BH)max 1.5 MG Oe can be easily attained. Also in case of the strontium ferrite magnet powders, excellent magnetic properties higher than Br2680G, Hc2400 Oe and (BH)max 1.71 MG Oe can be obtained. The surface condition of the plastics magnets obtained according to the present invention is very excellent due to the excellent fluidity of the resin.

EXAMPLE 2

Plastics magnets were molded in the same way as in Example 1 except that the injection was done at 230° C while applying radially a magnetic field of 3000 – 4000 Oe using a mold which could mold simultaneously ring-shape magnets of 38.8$\phi$ × 28.2$\phi$ × 25 mm and 27.5$\phi$ × 20.8$\phi$ × 16 mm. The results are shown in Table 2.

In this example also, in case of the Na cross-linked resin of ethylene-metacrylic acid copolymer and the saponified resin of ethylene-vinyl acetate copolymer, a better magnetic flux value can be obtained as compared with that obtained in case of the ethylene-vinyl acetate copolymer, and high dimensional accuracy can be obtained.

Conventionally these ring-shape magnets were obtained by sintering a sinter magnet and then grinding the inside and outer circumferences. The present invention eliminates such sintering and grinding steps, and thus can simplify the production process.

EXAMPLE 3

Figure 3:
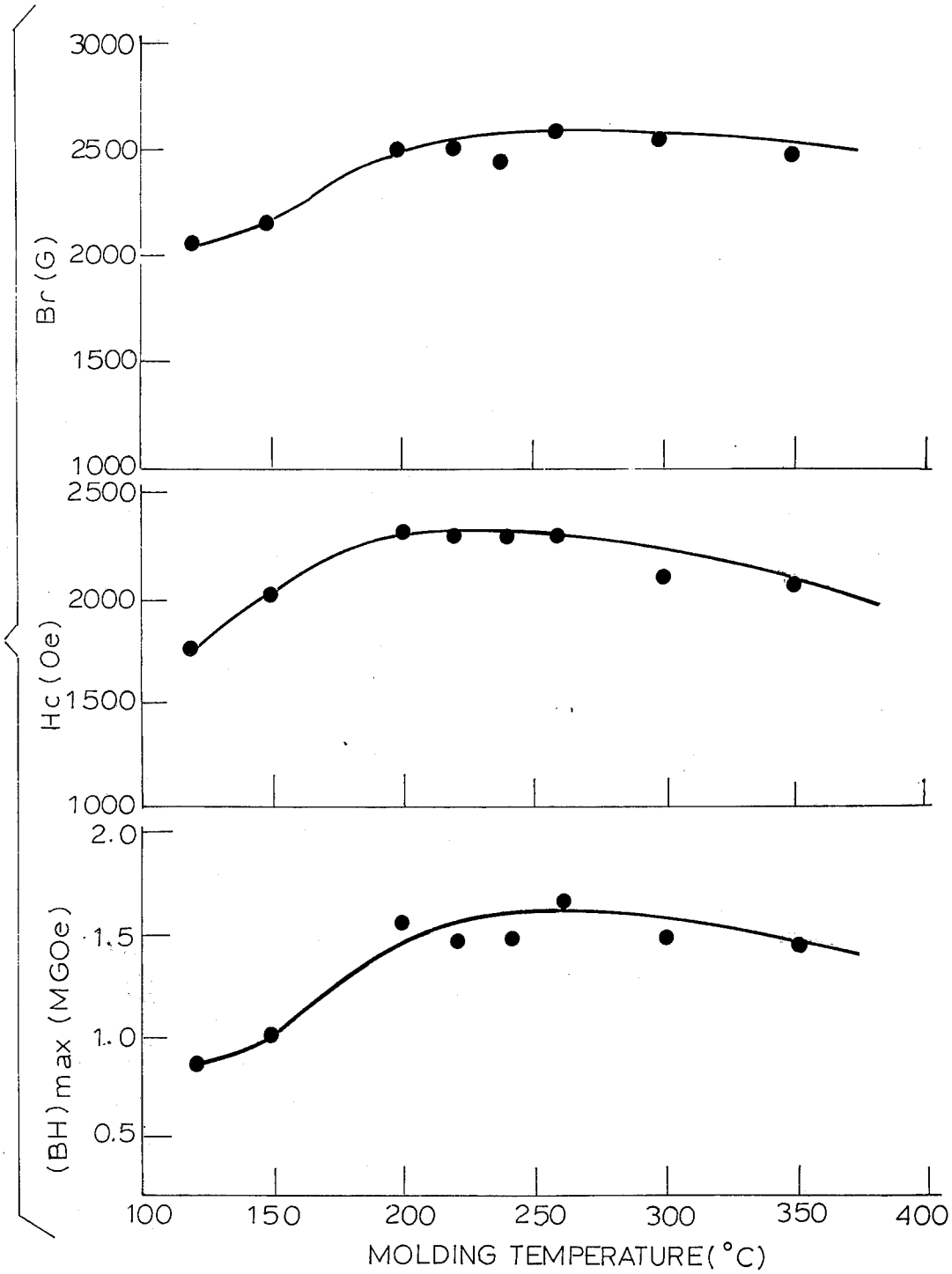
FIG. 3 shows the relation between the molding temperature and the magnetic properties when the mixture is molded while applying the magnetic field.

A mixture of 90% by weight of Ba-ferrite powders and 10% by weight of ethylene-metacrylic acid copolymer (AD8109) as in Example 1 was heated in a mold and molded under pressure while applying a magnetic field of 15000 Oe to obtain disc-shape specimens of 20 mm diameter and 5 mm thickness. The relation between the magnetic properties and the molding temperature is shown in FIG. 3. As clearly seen from the figure, the molding temperature ranges from 120° to 400° C, but the most desirable molding temperature range is from 200° C to 350° C. Below the lower limit of the temperature range, the molten viscosity of the mixture of ferromagnetic powders and resin is so high that the orientation rate of the ferromagnetic powders can not increase satisfactorily and the magnetic properties lowers. On the other hand, beyond the upper limit the resin tends to be decompose.

Table 1

| Resin | Proportion of Resin (%) | Proportion of Powders (%) | Forming Property | Br (G) | Hc (Oe) | (BH)max (MG Oe) |
|---|---|---|---|---|---|---|
| Low-density Polyethylene (Fl-60) | 12 | 88 | Slightly Good | 1480 | 1400 | 0.51 |
| M | 11 | 89 | Bad | — | — | — |
| 10% Ethylene-Vinyl Acetate Copolymer + 2% Isobutylene | 12 | 88 | Slightly Good | 2150 | 1800 | 1.09 |
| 7% Ethylene-Vinyl Acetate Copolymer + 5% Isobutylene | 12 | 88 | Bad | — | — | — |
| Ethylene-Vinyl Acetate Copolymer (EV-410) | 12 | 88 | Good | 2314 | 1956 | 1.28 |
| | 11 | 89 | Good | 2325 | 2022 | 1.28 |
| | 10 | 90 | Bad | — | — | — |
| Na-Cross-linked Copolymer of Ethylene and Metacrylic Acid (AD8109) | 12 | 88 | Good | 2345 | 2073 | 1.37 |
| | 11 | 89 | Good | 2500 | 2080 | 1.46 |
| | 10 | 90 | Good | 2528 | 2091 | 1.57 |
| | 9 | 91 | Slightly Good | 2480 | 2000 | 1.45 |
| Saponified Copolymer of Ethylene and Vinyl Acetate (D219) | 12 | 88 | Good | 2400 | 2010 | 1.40 |
| | 11 | 89 | Good | 2477 | 2028 | 1.49 |
| | 10 | 90 | Good | 2500 | 2100 | 1.50 |
| | 9 | 91 | Bad | — | — | — |

Table 2

| Resins | Proportion of Resin (%) | Proportion of Powders (%) | Forming Property | Ring Magnet 38.8$\phi$×28.3$\phi$× 25mm, Magnetic Flux $\Phi$ (max well) | Ring Magnet 27.5$\phi$×20.8$\phi$×16mm Magnetic Flux $\Phi$ (max well) |
|---|---|---|---|---|---|
| Ethylene-Vinyl Acetate Copolymer (EV-410) | 11 | 89 | Good | 11,295 | 4,550 |
| | 10 | 90 | Bad | — | — |
| Na-Cross-linked Copolymer of Ethylene and Metacrylic Acid (AD-8109) | 11 | 89 | Good | 12,438 | 5,226 |
| | 10 | 90 | Good | 13,045 | 5,430 |
| Saponified Copolymer of Ethylene and Vinyl Acetate (D-219) | 11 | 89 | Good | 11,885 | 4,690 |
| | 10 | 90 | Good | 12,100 | 4,850 |

EXAMPLE 4

A mixture of Na cross-linked resin AD8109 of ethylene-metacrylic acid copolymer and 95.5% by weight of samarium-cobalt magnet ($SmCo_5$) powders was molded in the same way as in Example 3 except for the molding temperature at 230° C. The magnetic properties of the product are shown in Table 3.

Table 3

| Resin | Resin Proportion | $SmCo_5$ Proportion | Br (G) | Hc (Oe) | (BH)max (MG Oe) |
|---|---|---|---|---|---|
| Na cross-linked Ethylene-Metacrylic Acid Copolymer AD8109 | 4.5% by weight | 95.5% by weight | 6800 | 4500 | 9.8 |

As described hereinbefore, the feature of the present invention lies in that a magnetic field is applied to the mixture of resin and magnet powders having uni-axial magnetic anisotropy while in a molten state at high temperatures and thus the easy magnetizable axis of the magnetic powders is oriented in the direction of the magnetic field applied to obtain a strongly anisotropic magnet from the mixture. The plastics magnet produced according to the present invention shows a high level of orientation of the magnetic powders. According to the X-ray observations, the orientation rate is as high as 95% or higher, and thus the magnetic properties of the magnet thus obtained is very high. For example, in case of the magnet using Ba-ferrite powders, the maximum energy product reaches as high as (BH)max 1.6 MgOe or higher, and in case of the cobalt-samarium ($SmCo_5$) magnet powders, the value is more than 9.8 MG Oe as shown in Example 4.

In the present invention, the magnet may be formed into a plate-shape, a bar-shape and a semi-circle-shape other than the disc-shape and the ring-shape.

What is claimed is:

1. An anisotropic plastics magnet having a maximum energy product of at least 0.9 MGOe, a remanence of at least 2000 G and a coercive force of at least 1800 Oe, said magnet being comprised of:

at least one ferromagnetic powder having a large magnetic anisotropy selected from the group consisting of:

$MO.6Fe_2O_3$ ferrite magnet powders, wherein M is selected from the group consisting of Ba, Sr and Pb, $RCo_5$ rare earth-cobalt magnet powders wherein R is at least one rate earth element selected from the group consisting of Sm, Pr, Ce, La and Y, manganese-bismuth magnet powders, and manganese-aluminum magnet powders; and at least one resin selected from the group consisting of:

metal-cross-linked copolymers of $\alpha$-olefin and $\alpha,\beta$-unsaturated mono- or dicarboxylic acid selected from the group consisting of: ethylene-acrylic acid copolymer, ethylene-metacrylic acid copolymer, ethylene-acrylic acid-metacrylic acid copolymer, ethylene-acrylic acid-methacrylic acid methyl ester copolymer and ethylene-metacrylic acid-acrylic acid methyl ester copolymer, with said metal ion selected from the group consisting of: $Na^+$, $K^+$, $Li^+$, $Cn^+$, $Be^{++}$, $Mg^{++}$, $Ca^{++}$, $Ba^{++}$, $Cu^{++}$, $Fe^{++}$, $Co^{++}$, $Ni^{++}$, $Zn^{++}$, $Al^{+++}$, $Sc^{+++}$, $Fe^{+++}$ and $Y^{+++}$, and a saponified resin of a copolymer of ethylene and vinyl acetate, the axis of the easy magnetization of said ferromagnetic powders being oriented substantially in one direction.

2. A magnet as claimed in claim 1 wherein said $MO.6Fe_2O_3$ ferrite magnet powder is present in an amount of from 85 to 92% by weight.

3. A magnet as claimed in claim 1, wherein said $RCo_5$ rare earth-cobalt magnet powder is present in an amount of from 85 to 96% by weight.

4. A magnet as claimed in claim 1 wherein said saponified copolymer of ethylene and vinyl acetate is a copolymer containing 1 to 45% by weight of vinyl acetate in which the hydroxyl radical (OH) is introduced between molecules by hydrolysis according to the following reaction:

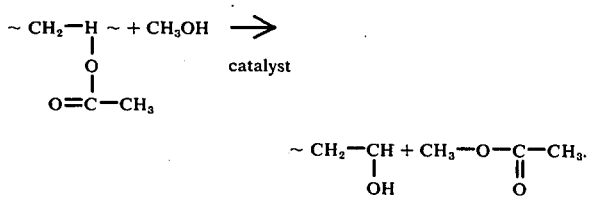

5. A magnet as claimed in claim 1 wherein the saponified copolymer of ethylene and vinyl acetate is one selected from the group consisting of ethylene-vinyl alcohol copolymer and ethylene-vinyl alcohol-vinyl acetate copolymer, containing 15 to 45% by weight vinyl acetate and having a 25 to 100% hydrolysis rate.

6. A magnet as claimed in claim 1 wherein up to 50% of said resins are replaced by at least one thermoplastic resin selected from the group consisting of: polyethylene, polypropylene, polystyrene, chlorinated polyethylene, ethylene-vinyl acetate copolymer and ethylene-ethylacrylate copolymer.

* * * * *